US008379362B2

(12) United States Patent
Kasper

(10) Patent No.: US 8,379,362 B2
(45) Date of Patent: Feb. 19, 2013

(54) ELECTRICAL CIRCUIT HAVING A MEANS FOR SIGNALING

(75) Inventor: Norbert Kasper, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 200 days.

(21) Appl. No.: 12/936,994

(22) PCT Filed: Mar. 12, 2009

(86) PCT No.: PCT/EP2009/052907

§ 371 (c)(1),
(2), (4) Date: Oct. 8, 2010

(87) PCT Pub. No.: WO2009/124820

PCT Pub. Date: Oct. 15, 2009

(65) Prior Publication Data

US 2011/0038089 A1 Feb. 17, 2011

(30) Foreign Application Priority Data

Apr. 11, 2008 (DE) ..... 20 2008 005 085 U

(51) Int. Cl.
*H01H 73/00* (2006.01)

(52) U.S. Cl. ..... 361/115

(58) Field of Classification Search ..... 361/115, 361/117

See application file for complete search history.

(56) References Cited

U.S. PATENT DOCUMENTS

| | | | | |
|---|---|---|---|---|
| 4,382,270 | A | 5/1983 | Davidson et al. | |
| 4,739,450 | A * | 4/1988 | Misencik | 361/733 |
| 7,173,799 | B1 * | 2/2007 | Weeks et al. | 361/42 |

FOREIGN PATENT DOCUMENTS

| | | |
|---|---|---|
| DE | 3634456 C1 | 2/1988 |
| EP | 0897186 A3 | 2/1999 |
| EP | 1628317 A3 | 2/2006 |

* cited by examiner

*Primary Examiner* — Jared Fureman
*Assistant Examiner* — Terrence Willoughby
(74) *Attorney, Agent, or Firm* — Lawrence E. Laubscher, Sr.; Lawrence E. Laubscher, Jr.

(57) ABSTRACT

Indicating apparatus for indicating the operating state of a component of an electrical load protection system, including a housing containing a longitudinal chamber, an indicating member mounted for longitudinal displacement in the chamber, a resilient device normally biasing the indicating member toward a first end of the housing, a catch arrangement for retaining the indicating member in a retracted position adjacent the housing second end; and a release device responsive to a trouble voltage pulse for operating the catch arrangement to a released condition, thereby to release the indicating member for displacement toward an indicating position adjacent the housing first end. At least the first end of the housing is transparent, thereby to provide a visual indication when the indicating member is in the indicating position. Switch contacts are operable between open and closed conditions when the indicating member is displaced between the indicating and retracted positions.

11 Claims, 5 Drawing Sheets

PRIOR ART

ELECTRICAL CIRCUIT HAVING A MEANS FOR SIGNALING

REFERENCE TO RELATED APPLICATIONS

This application is a national stage under 35 U.S.C. 371 of PCT International Application No. PCT/EP2009/052907 filed Mar. 12, 2009, which claims priority of German Application No. 20 2008 005 085.5 filed Apr. 11, 2008. It is related to the inventor's U.S. application Ser. Nos. 12/934,937 and 12/935,001, both filed Sep. 27, 2010.

BACKGROUND OF THE INVENTION

1. Field of the Invention

Indicating apparatus is provided for indicating the operating state of an electrical component of a load protection system, including a housing containing a longitudinal chamber, an indicating member mounted for longitudinal displacement in the housing chamber, a resilient device normally biasing the indicating member toward a first end of the housing, a catch arrangement for retaining the indicating member in a retracted position adjacent the housing second end; and a release device responsive to a trouble voltage pulse for operating the catch arrangement to a released condition, thereby to release the indicating member for displacement by the resilient device toward an indicating position adjacent the housing first end.

2. Description of Related Art

Electrical systems, for example, electrical installations or electrical lines, are protected against trouble events to ensure trouble-free operation by means of protective devices against impairment of their function and/or against destruction.

These electrical circuits with signaling means can signal at least one functional state, for example, functionally capable or defective, for a protective device. In this way, one can facilitate the checking and/or maintenance of protective devices because an expert entrusted with monitoring does not have to do any measurements on a protective device in order to get information on the functional state of that device. The functional state of a protective device that is to be monitored can be perceived directly by means of signaling action, for example, via optical signaling.

In the context of the present invention, a trouble event is intended to mean an event whose occurrence impacts an electrical system with electrical energy, specifically in such a way that the orderly function of the electrical system is impaired or destroyed. Examples of trouble events are lightning strikes or static discharges, as a result of which, overvoltage pulses and/or over-current pulses are introduced, for example, galvanically, inductively or capacitively into the electrical system, thus impairing or destroying the function of that system. Protective devices against overvoltage pulses have protective elements, among other things, for example, spark gaps, varistors, diodes, suppressor diodes, and are well familiar to the expert. Such protective devices are also referred to as OVP (overvoltage protection).

Furthermore, in the context of this invention, a trouble event is understood to involve a voltage surge with which an electrical system, for example, an electrical power line, can be overloaded and/or destroyed by means of a short circuit or short to ground. Protective devices to provide protection against overvoltage currents are commonly referred to as fuses and are familiar to the expert in many different models, for example, in the form of lead fuses or automatic cutoffs.

Also known are circuits with means for signaling at least one functional state. Reference is made now to FIGS. 3*a* and

3*b* to explain such a known circuit of the prior art. Shown is a fuse that connects two electrical forward break points. To signal a functional state of the fuse, there is connected parallel to it a series connection consisting of a voltage multiplier and an opposite parallel circuit consisting of two light diodes. If the fuse is functioning properly, then the voltage prevailing between the two break points will be too small to supply the light diodes with a voltage adequate to get them to light up. If the fuse, for example, is destroyed by an excessively high current and it therefore interrupts the flow of current, then the voltage will rise between the two forward break points and the light diodes will be supplied with adequate voltage in order to signal a defect of the fuse as a functional state lights up in this fashion. It is obvious that, depending on the type of voltage, whether it is direct or alternating voltage, only one or both of the light diodes will light up in each case.

The disadvantage in the known circuits is represented by the fact that the means used for signaling, for example, a light diode, require electrical energy to maintain the signaling function and cause a repercussion on the protective device whose function is to be monitored and/or a facility that supplies electrical energy.

The present invention was developed to solve these problems by an improved electrical protective circuit equipped with signaling means for signaling faulty conditions.

SUMMARY OF THE INVENTION

Accordingly, a primary object of the present invention is to provide an indicating device for indicating the operating state of an electrical component of a load protection system, including a housing containing a longitudinal chamber, an indicating member mounted for longitudinal displacement in the housing chamber, a resilient device normally biasing the indicating member toward a first end of the housing, a catch arrangement for retaining the indicating member in a retracted position adjacent the housing second end, and a release device responsive to voltage pulse for operating the catch arrangement to a released condition, thereby to release the indicating member for displacement by the resilient device toward an indicating position adjacent the housing first end.

According to a more specific object of the invention, at least the first end of the housing is transparent, thereby to provide a visual indication when the indicating member is in the indicating position. The indicating member may be provided with one or more distinctive colors.

According to another object, switch contacts may be provided that are operable between open and closed conditions when the indicating member is in the indicating position, thereby to provide an electrical indication as to the position of the indicating member relative to the housing.

A further object is to provide a signaling means that is executed in a pulse-activated and stable fashion, which after pulse activation does not have any circuit repercussions and which is designed for permanent, nonvolatile signaling.

Otherwise, advantageously for permanent signaling of a functional state, no electrical energy is required, and one can prevent the repercussion of the signaling means.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1B:
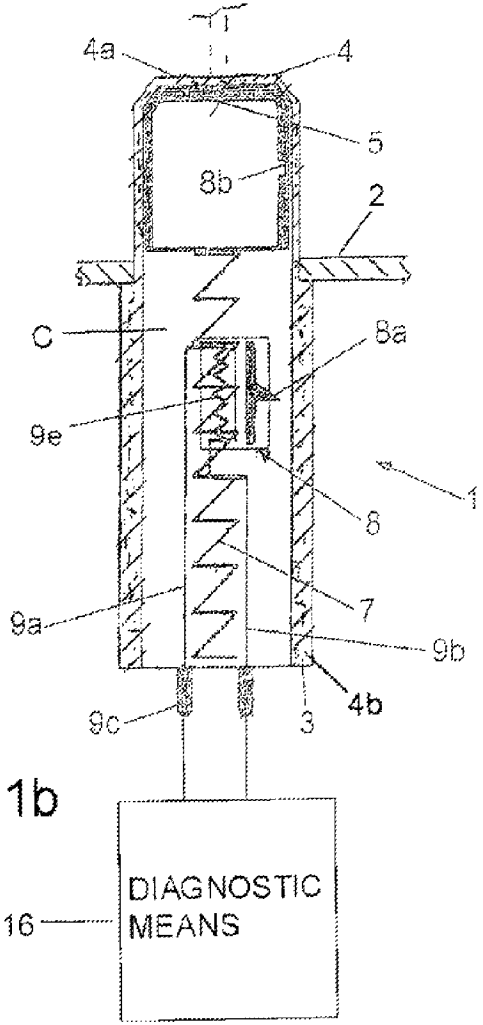
FIGS. 1*a* and 1*b* are sectional longitudinal views of the indicating device of the present invention when in the retracted and extended viewing conditions, respectively.
Figure 1A:
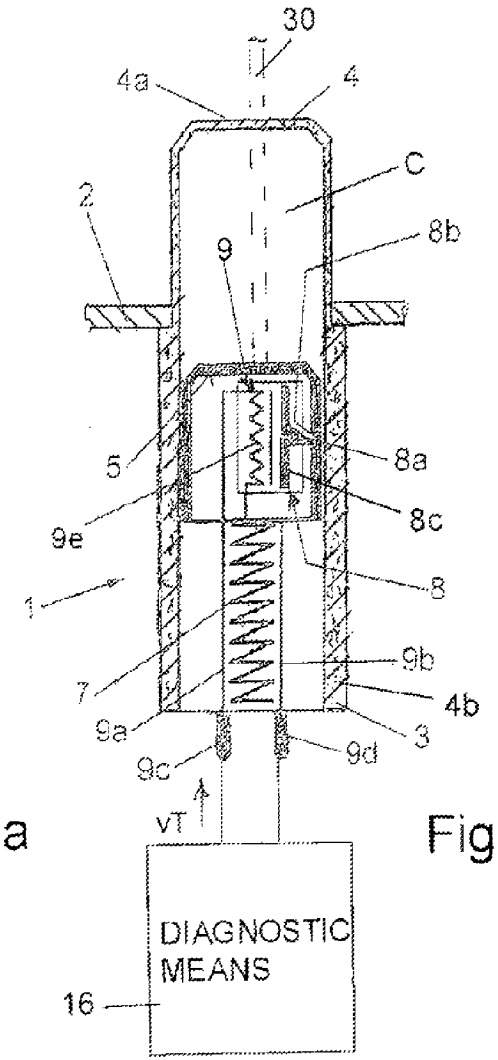

Referring first more particularly to FIGS. 1 and 2, the signaling apparatus 1 of the present invention includes a hollow housing 3 that is mounted in an opening contained in a support wall 2, said housing containing a vertical longitudinal chamber C, and including upper first and lower second end portions 4*a* and 4*b*. Preferably, at least the upper end portion 4*a* of the housing is formed from a transparent synthetic plastic material. Mounted for sliding longitudinal displacement in the housing chamber C is an indicating member 5 having an inverted generally cup-shaped configuration. A helical compression spring 7 biases the indicating member 5 upwardly in housing chamber C from the retracted position of FIG. 1*a* toward the upper indicating position of FIG. 1*b* adjacent the transparent upper housing end 4*a*. The indicating member 5 is normally retained in the retracted position of FIG. 1*a* by catch means 8 including a catch member 8*c* supported against vertical displacement in the chamber C, which catch member is provided with a catch projection 8*a* that extends within an opposed catch opening 8*b* contained in the annular wall portion of the indicating member 5.

The catch member 8*c* is preferably formed from a ferromagnetic material that defines the armature of solenoid means 9 including a solenoid 9*e* mounted against vertical displacement in the housing chamber C. The solenoid 9*e* is supplied with a trouble voltage pulse $V_T$ from diagnostic means 16 via solenoid terminals 9*c* and 9*d* and conductors 9*a* and 9*b*, respectively, thereby to attract the armature 8*c* to withdraw catch projection 8*a* from the opening 8*b*. The indicating member 5 is thus released and displaced upwardly by the compression spring 7 toward the indicating position of FIG. 1*b*, whereupon the indicating member becomes visible thought the transparent housing end wall 4*a*. To increase the visibility of the indicating member 5, it may be provided with one or more distinctive colors, including fluorescent colors.

Reset means are provided for resetting the indicating member to its FIG. 1 retracted position, said reset means including a manually operable rod 30 that slidably extends downwardly through an opening contained in the housing upper end portion 4*a*. Consequently, the indicating member 5 can be reset from the second position again into the first position, for example, after a repair has been done on a protective device that has to be monitored.

Figure 2B:
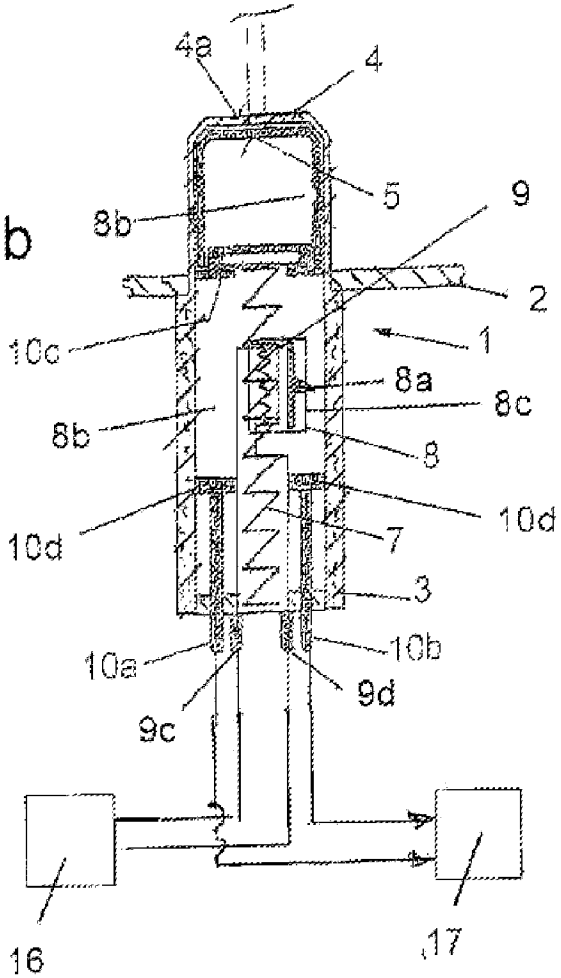
FIGS. 2*a* and 2*b* illustrate a modification of the apparatus of FIGS. 1*a* and 1*b*, including electrical contacts that are operable between first and second conditions when the indicating member is in the retracted and extended positions, respectively.
Figure 2A:
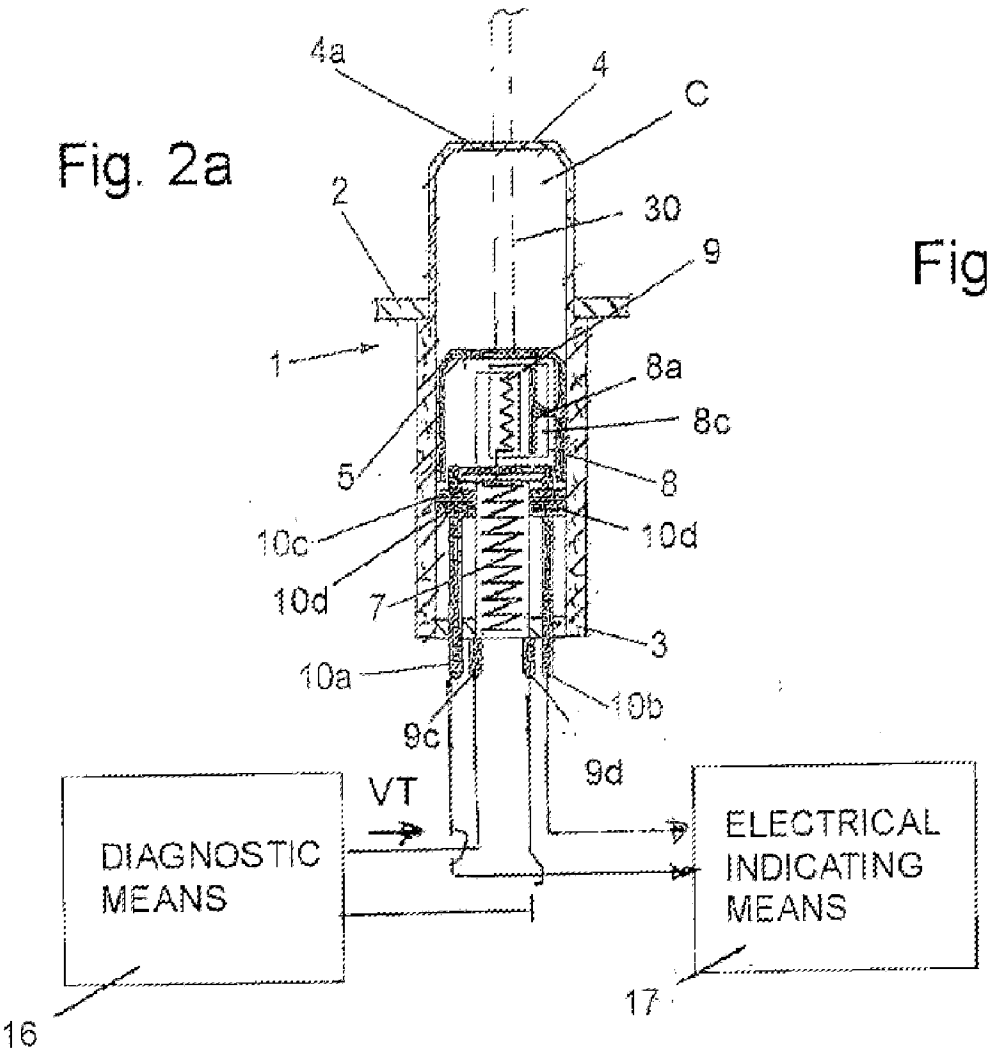

According to a modification of the invention shown in FIGS. 2*a* and 2*b*, the indicating device 1 may be provided with normally closed movable and stationary switch contacts 10*c* and 10*d*, respectively. The movable contact 10*c* is mounted on the indicating member 5 for bridging engagement with the stationary contact 10*d* when the indicating member 5 is in the retracted position shown in FIG. 2*a*. The stationary contact has separate portions connected with switch terminals 10*a* and 10*b* that extend from the lower second end portion of the housing 3. Consequently, when a trouble pulse $V_T$ is supplied to solenoid terminals 9*c* and 9*d*, the solenoid means 9 is energized to attract armature 8*c*, thereby to withdraw the catch projection 8*a* from the opening 8*b*. The indicating member is released for upward displacement by the compression spring 7, whereupon switch contacts 10*c* and 10*d* are separated to break the internal connection between switch terminals 10*a* and 10*b*.

Figure 3A:
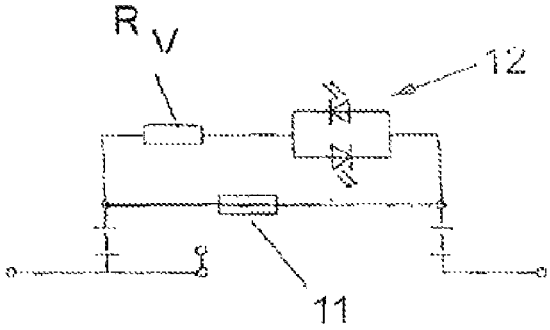
Fig. 3a PRIOR ART
FIGS. 3*a* and 3*b* indicate a fuse condition indicating arrangement of the prior art when a protective fuse is in its conducting and blown conditions, respectively.
Figure 3B:
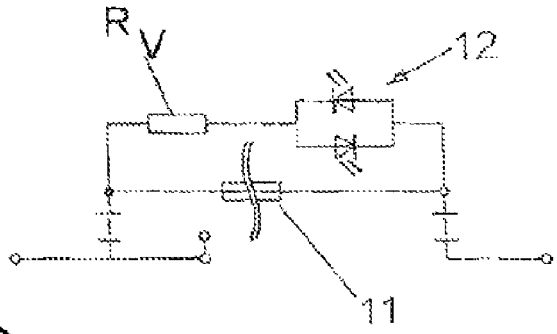

In the prior art arrangement of FIGS. 3*a* and 3*b*, it has been proposed to provide indicating means 12 in the form of a pair of light-emitting diodes of opposite polarity connected in parallel for visually indicating the operating condition of a fuse 11. The LED arrangement is connected in series with the voltage adjusting resistor Rv to define an indicating branch that is connected across the fuse 11.

Figure 4A:
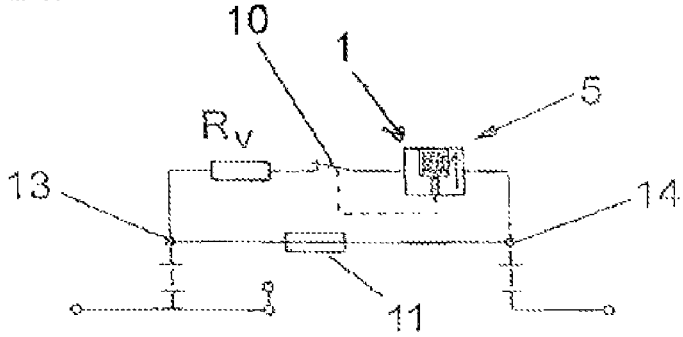
FIGS. 4*a* and 4*b* are corresponding views of a fuse protection circuit provided with the indicating device of the present invention.
Figure 4B:
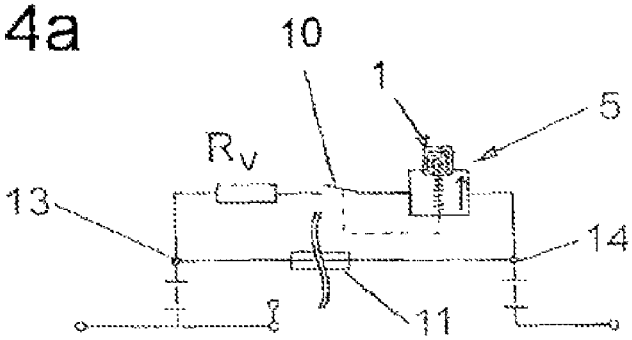

In accordance with the present invention, the LED arrangement of the prior art is replaced by the signaling means 1 of the present invention, as illustrated in FIGS. 4*a* and 4*b*. In this case, when a trouble pulse is sent to the signaling means 1 of FIG. 4*a*, the solenoid means 9 is activated to attract the armature to release the catch means 8, whereupon indicating member 5 is displaced by spring 7 toward the visual display condition of FIG. 4*b*, and the contacts of switch means 10 are opened. The current flow through the electromagnet is thus interrupted, the electromagnet 9 is dead and thus does not absorb any electrical output. Signaling element 5 remains in the second position as shown in FIG. 4*b* (see also FIGS. 1*b* and 2*b*) and permanently signals the functional state of the protective device. By opening the contacts 10*a*, 10*b* and 10*c*, 10*d* (see FIGS. 2*a* and 2*b*), the galvanic connection between connection points 13 and 14 is interrupted so that the signaling element 5 does not cause any repercussion on the circuit and on the protective device that is to be monitored, in this case, fuse 11.

Figure 5A:
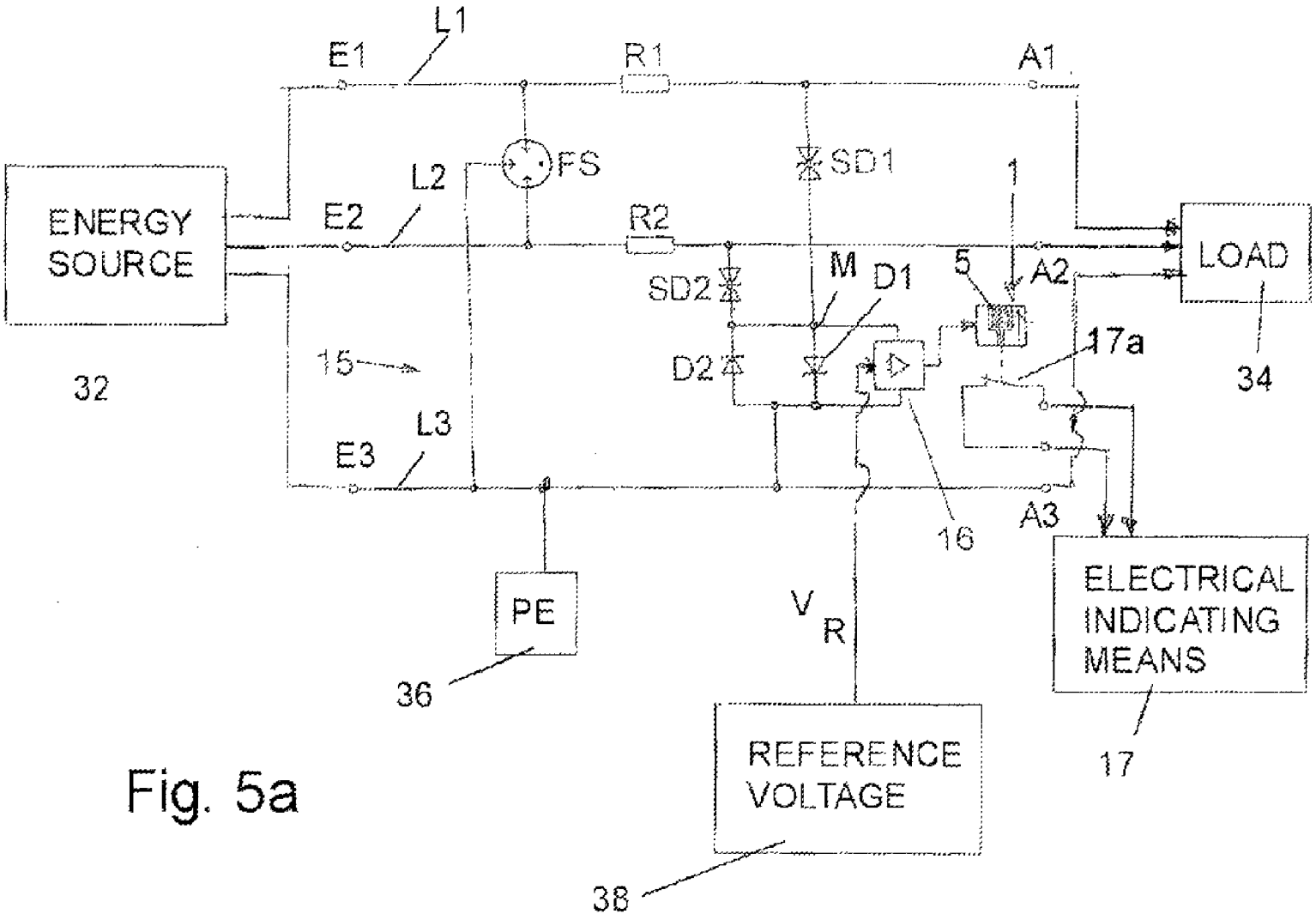
FIGS. 5*a* and 5*b* are circuit diagrams of the complete protective system of the present invention when in the inactive and active conditions, respectively.
Figure 5B:
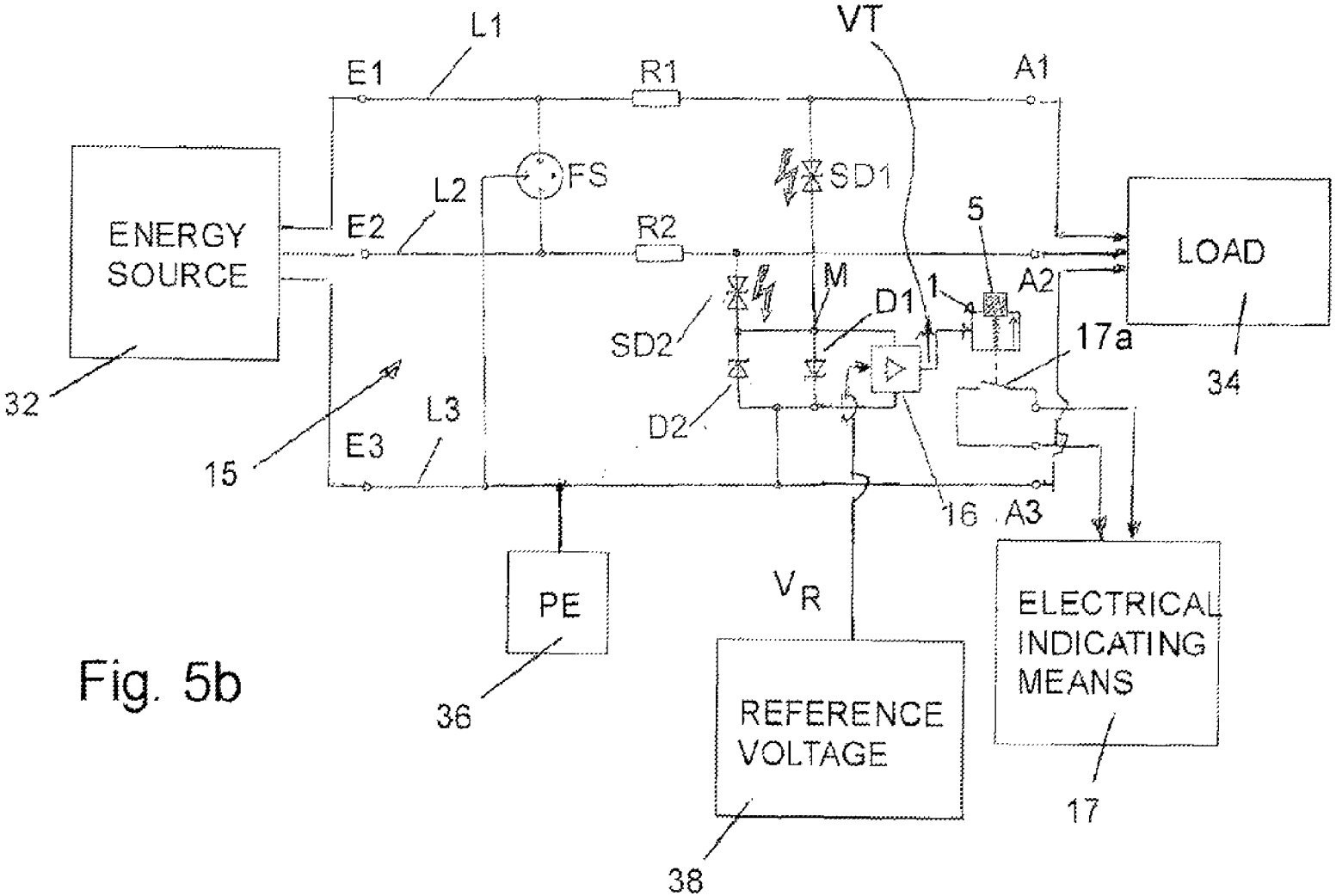

Referring now to FIGS. 5*a*, and 5*b*, the trouble condition indicating means 1 of the present invention is illustrated in connection with an overvoltage protection system 15 in which electrical power from source 32 is supplied to a load 34, such as an industrial printed circuit board, an amplifier, or the like. The protection circuit includes three lines L1, L2, L3 having input terminals E1, E2, E3, connected with the power source 32, and three output terminals A1, A2, and A3 connected with the load 34, respectively. Upon the occurrence of a severe trouble event, such as lightning or a severe overvoltage surge, a coarse voltage protection device FS serves to dissipate the major portion of the electrical trouble energy. As is known in the art, the coarse protection device FS includes a hollow housing containing means defining a first spark gap between the third and first lines L3 and L1, and means defining a second spark gap between the third and second lines L3 and L2.

Fine protection means are provided for protecting the load against any residual energy that might remain in the circuit. In this regard, the first and second lines L1 and L2 contain series-connected resistors R1 and R2, respectively, and the third line L3 is maintained at a given potential PE from source 36. First and second suppressor diodes SD1 and SD2 have first electrodes connected with the first and second lines L1 and L2, respectively, and second electrodes connected with a common measuring junction M, which junction is connected with the third line L3 via a circuit branch including a pair of diodes D1 and D2 of opposite polarity connected in parallel.

The spark gap device FS and the suppressor diodes SD1 and SD2 are subject to destruction upon the occurrence of a severe trouble condition. In order to indicate the state of operation of the suppressor diodes SD1 and SD2, a diagnostic circuit 16 is connected between the measuring junction M and third line L3 in parallel across the parallel branch defined by diodes D1 and D2. The diagnostic circuit 16 compares the voltage across the diode branch with a reference voltage $V_R$ supplied by source 38, and if a trouble condition is detected, sends a trouble signal $V_T$ to the solenoid means 9 of the indicating device 1. The indicating means 1 is then operated from the initial retracted condition of FIG. 5*a* to the indicating condition of FIG. 5*b*, such that the indicating member 5 is in a visible position relative to its housing, and switch contact 10*c* is operated to the open condition, thereby to disconnect the electrical indicating means 17.

In any case, protective device 15 and the electrical system to be protected are so installed and wired that in case of a trouble event, an injected electrical energy is injected on the input side of protective device 15. The electrical trouble pulse $V_T$ activates the signaling device 5 such that there will be a permanent and current-free signaling of the functional state of the protective device 15. Furthermore, here again, any repercussions are eliminated by means of the wiring setup explained on the basis of FIGS. 4*a* and 4*b* with the opener constituted by the means 10*a*, 10*b* and 10*c*, 10*d* (see FIGS. 2*a* and 2*b*). In addition to the contact already described, the signaling means 5 can have another contact 17*a*, for example, a further system 17 for reporting of a functional state and an indicating or recording electrical system.

While in accordance with the provisions of the Patent Statutes the preferred forms and embodiments of the invention have been illustrated and described, it will be apparent to those skilled in the art that changes may be made without deviating from the invention described above.

What is claimed is:

1. Indicating apparatus (1) for indicating the operating state of an electrical component of a load protection system, comprising:

(a) a housing (3) containing a longitudinal chamber (C), said housing having a closed first end portion (4*a*) formed of a transparent material, and a second end portion (4*b*);

(b) an indicating member (5) mounted for longitudinal displacement in said chamber between a retracted position spaced from said housing first end portion, and an indicating position contained within said first end portion;

(c) resilient means (7) for normally biasing said indicating member relative to said housing toward said indicating position;

(d) catch means (8) arranged in said housing chamber for retaining said indicating member in said retracted position, said catch means including:

(1) a catch member (8*c*) arranged in said housing chamber for transverse displacement between a normal locked position and an unlocked position;

(2) said catch member being formed of a ferromagnetic material and having a catch projection (8*a*) arranged to extend into a catch opening (8*b*) contained in said indicating member when said indicating member is in said retracted position and said catch member is in said locked position; and (e) solenoid means (9) responsive to a trouble voltage pulse ($V_T$) for operating said catch means from said locked position to said unlocked position, thereby to release said indicating member for displacement by said resilient means from said retracted position toward said indicating position.

2. Indicating apparatus as defined in claim 1, wherein said solenoid means includes:

(1) a solenoid (9*e*) mounted in said chamber opposite said catch member;

(2) a pair of solenoid terminals (9*c*, 9*d*) extending from said housing second end; and (3) a pair of conductors (9*a*, 9*b*) connecting said solenoid terminals with the ends of said solenoid, respectively; and (f) diagnostic means (16) for sending a trouble pulse ($V_T$) to said solenoid terminals.

3. Indicating apparatus as defined in claim 2, and further including:

(g) a support wall (2) containing an opening, an intermediate portion of said housing being mounted in said wall opening such that said housing first end extends visibly on one side of said opening, and said second housing end extends from the other side of said opening.

4. Indicating apparatus as defined in claim 3, wherein said indicating member has at least one distinctive color.

5. Indicating apparatus as defined in claim 2, wherein said indicating member is generally cup-shaped and open at one end, said catch means and said solenoid being contained within said indicating member when said indicating member is in said retracted position.

6. Indicating apparatus as defined in claim 5, and further including reset means (30) for resetting said indicator member to said retracted condition.

7. Indicating apparatus as defined in claim 5, and further including fuse means (11) connected in parallel across said indicating means.

8. Indicating apparatus as defined in claim 1, and further including:

(f) electrical indicating means (17) for indicating the position of said indicating member relative to said retracted position, including:

(1) two stationary switch contacts (10*d*) connected with said housing;

(2) two movable switch contacts (10*c*) connected with and bridged by said indicating member, said stationary and movable switch contacts being operable between engaged and disengaged conditions when said indicating member is in its retracted and released positions, respectively;

(3) at least two indicating terminals (10*a*, 10*b*) extending from said housing second end, said terminals being connected with said stationary switch contacts, respectively; and (4) an electrical indicating arrangement connected with said indicating terminals.

9. Indicating apparatus as defined in claim 1, and further including:

(f) an overvoltage protection circuit (15) for protecting a load (22) against damage by lightening, voltage surge, or other trouble event, said load (22) being supplied with electrical power from an electrical energy source (20), said overvoltage protection circuit including:

(1) at least three lines (L1, L2, L3) having input terminals (E1, E2, E3) respectively connected with the voltage source, and output terminals (A1, A2, A3) connected with the load;

(2) coarse protection means (FS) for dissipating the major portion of the energy of the trouble event, said course protection means including a first spark gap connected between a first one of said lines (L1) and a third one of said lines (L3), and a second spark gap connected between a second one of said lines (L2) and said third line (L3);

(3) fine protection means for limiting to a safe degree the remaining portion of the energy of the trouble event, said fine protection means including:

(a) a first suppressor diode (SD1) connected between said third and first lines, and (b) a second suppressor diode (SD2) connected between said third and second lines;

(c) said first and second suppressor diodes each being subject to destruction upon overload above a given voltage value; and (4) diagnostic means (16) for determining the state of operation of said suppressor diodes, said diagnostic means including trouble event identifying means for supplying to said solenoid means a trouble pulse ($V_T$) in the event that at least one of said suppressor diodes is in a destructed condition, thereby to effect release of said catch means.

10. Indicating apparatus as defined in claim 9, and further including:

(g) normally deactivated electrical indicating means (17), and switch means (17*a*) for activating said electrical indicating means when said indicating member is in said indicating position.

11. Indicating apparatus as defined in claim 10, wherein said suppressor diodes have common terminals connected with a measuring junction (M); and further wherein said protection circuit includes a circuit branch connecting said measuring junction with said third conductor, said circuit branch comprising a pair of diodes (D1, D2) of opposed polarity connected in parallel, said diagnostic means being connected in parallel across said circuit branch.

* * * * *